US008993912B2

(12) United States Patent
Naiman et al.

(10) Patent No.: US 8,993,912 B2
(45) Date of Patent: Mar. 31, 2015

(54) SWITCHING APPARATUS

(71) Applicants: Pavel Naiman, Letohrad (CZ); Milos Petracek, Letohrad (CZ)

(72) Inventors: Pavel Naiman, Letohrad (CZ); Milos Petracek, Letohrad (CZ)

(73) Assignee: Siemens Aktiengesellschaft, Munich (DE)

( * ) Notice: Subject to any disclaimer, the term of this patent is extended or adjusted under 35 U.S.C. 154(b) by 110 days.

(21) Appl. No.: 13/746,472

(22) Filed: Jan. 22, 2013

(65) Prior Publication Data

US 2013/0220787 A1 Aug. 29, 2013

(30) Foreign Application Priority Data

Feb. 28, 2012 (DE) ..... 10 2012 203 042

(51) Int. Cl.

| | |
|---|---|
| ***H01H 23/00*** | (2006.01) |
| ***H01H 23/02*** | (2006.01) |
| ***H01H 71/50*** | (2006.01) |
| ***H01H 71/52*** | (2006.01) |
| *H01H 1/20* | (2006.01) |
| *H01H 73/04* | (2006.01) |

(52) U.S. Cl.

CPC ..... *H01H 23/02* (2013.01); *H01H 71/501* (2013.01); *H01H 71/521* (2013.01); *H01H 1/2058* (2013.01); *H01H 71/526* (2013.01); *H01H 73/045* (2013.01)

USPC ..... 200/401

(58) Field of Classification Search

USPC ..... 200/401, 19.22, 19.27, 43.01, 43.16, 200/43.19, DIG. 42

See application file for complete search history.

(56) References Cited

U.S. PATENT DOCUMENTS

| | | | | |
|---|---|---|---|---|
| 5,296,664 | A | 3/1994 | Castelein et al. | |
| 5,543,595 | A * | 8/1996 | Mader et al. | 200/401 |
| 5,910,760 | A | 6/1999 | Malingowski et al. | |
| 6,423,913 | B1 * | 7/2002 | Gupta et al. | 200/50.11 |
| 6,429,760 | B1 * | 8/2002 | Greenberg et al. | 335/202 |

FOREIGN PATENT DOCUMENTS

| | | | |
|---|---|---|---|
| DE | 69833145 | T2 | 10/2006 |
| EP | 1515351 | A2 | 3/2005 |

* cited by examiner

*Primary Examiner* — Edwin A. Leon
*Assistant Examiner* — Anthony R. Jimenez
(74) *Attorney, Agent, or Firm* — Harness, Dickey & Pierce, P.L.C.

(57) ABSTRACT

A switching apparatus for an electrical switching device, the switching device including a rotor housing rotatable between an open position and a closed position; at least one contact arm with a moving contact; and a switching unit with a switching lever, movable between an ON position and an OFF position, a switching frame, and a lever mechanism in functional contact with the switching frame and the rotor housing such that movement of the switching lever into the ON position allows the rotor housing to be moved into the closed position and movement of the switching lever into the OFF position allows the rotor housing to be moved into the open position. The lever mechanism includes at least one stop, configured to prevent movement of the switching lever into the OFF position, independently of the movement of the rotor housing, when the rotor housing is in the closed position.

18 Claims, 3 Drawing Sheets

SWITCHING APPARATUS

PRIORITY STATEMENT

The present application hereby claims priority under 35 U.S.C. §119 to German patent application number DE 10 2012 203 042.5 filed Feb. 28 2012, the entire contents of which are hereby incorporated herein by reference.

FIELD

At least one embodiment of the present invention generally relates to a switching apparatus for an electrical switching device, in particular a molded case circuit breaker, and such an electrical switching device.

BACKGROUND

Switching apparatuses for electrical switching devices and such electrical switching devices are known in principle. In order to be able to activate and deactivate a power circuit, such switching apparatuses frequently have a rotatable rotor housing, which can be rotated between an open position and a closed position. In the closed position contacts are connected to one another in an electrically conducting manner, while in the open position said contacts are isolated electrically from one another.

Also provided with known switching apparatuses is a switching unit, which can be moved by way of a switching lever at least between an ON position and an OFF position. A lever mechanism is frequently provided between the switching unit and the rotatable rotor housing, converting the movement between the ON position and the OFF position to a movement between the closed position and the open position of the rotor housing. In other words the switching lever can be used to activate and deactivate the switching apparatus. Known switching apparatuses are used for example to activate and deactivate or monitor electrical networks. Such switching apparatuses are therefore frequently provided with trip mechanisms, which isolate the power circuit in the event of a short circuit or current increases for some other reason, in other words they rotate the rotor housing into the open position.

It can happen with known switching apparatuses that a failure results in the interior of the switching apparatus due to very large short circuit currents. When the contacts are isolated therefore arcing can occur, causing the contacts to become welded together due to its high temperatures. In other words a moving contact is not released from a fixed contact at this point, even though the switching lever moves from the ON position.

With known switching apparatuses after tripping, also referred to as a TRIP situation, the functionality of the trip mechanism must be restored. With known switching apparatuses the switching lever is moved by way of a RESET position into the OFF position for this purpose. In this process for example a spring element is tensioned, so that during subsequent operation a new tripping operation can take place by way of the force stored in the spring element. If however after tripping the fixed contacts are welded to the moving contacts, there is a risk that the decoupling of the switching lever or switching unit from the rotor housing will still cause movement of the switching lever into the OFF position or by way of the RESET position into the OFF position.

Despite the switching lever being positioned in the OFF position, in other words giving the appearance that the switching apparatus is disconnected from the power, the welding of the moving contact to the fixed contact here would mean that the power circuit of the switching apparatus is closed. In such an instance therefore the switching apparatus provides incorrect information, so there is a risk of a user of an inventive switching apparatus suffering an electric shock from a machine due to the misinformation from the OFF position of the switching lever. Such positioning of the switching lever in the OFF position when the switching circuit is activated due to the closed position of the rotor housing is also referred to as a positive off. This situation carries a major risk, as the switching lever in the OFF position suggests protection that is not there, in other words a currentless power circuit.

SUMMARY

At least one embodiment of the present invention eliminates at least one of the disadvantages of known switching apparatuses as set out above, at least to some degree. In particular at least one embodiment of the present invention is to provide a switching apparatus for an electrical switching device, and such an electrical switching device, which can improve the safety of an inventive switching apparatus after tripping in an economical and simple manner.

Further features and details of the invention will emerge from the subclaims, the description and the drawings. Features and details described in the context of at least one embodiment of the inventive switching apparatus naturally also apply in the context of at least one embodiment of the inventive electrical switching device and vice versa, so that reference is or can always be made reciprocally to the individual aspects of at least one embodiment of the invention in respect of the disclosure.

At least one embodiment of an inventive switching apparatus for an electrical switching device, in particular a molded case circuit breaker, has a rotor housing that can be rotated between an open position and a closed position. Provided on the rotor housing is at least one contact arm, which has a moving contact. When the rotor housing is in the closed position said contact is connected to a fixed contact of the switching apparatus in an electrically conducting manner. The contact arm will generally have at least two moving contacts, which can be brought into contact correspondingly with two fixed contacts of the switching apparatus in an electrically conducting manner.

BRIEF DESCRIPTION OF THE DRAWINGS

A further embodiment of an electrical switching device includes at least one inventive switching apparatus. Such an electrical switching device therefore has the same advantages as have been described in detail in respect of an inventive switching apparatus.

Embodiments of the present invention is described in more detail with reference to the accompanying schematic drawings, in which.

DETAILED DESCRIPTION OF THE EXAMPLE EMBODIMENTS

Figure 1:
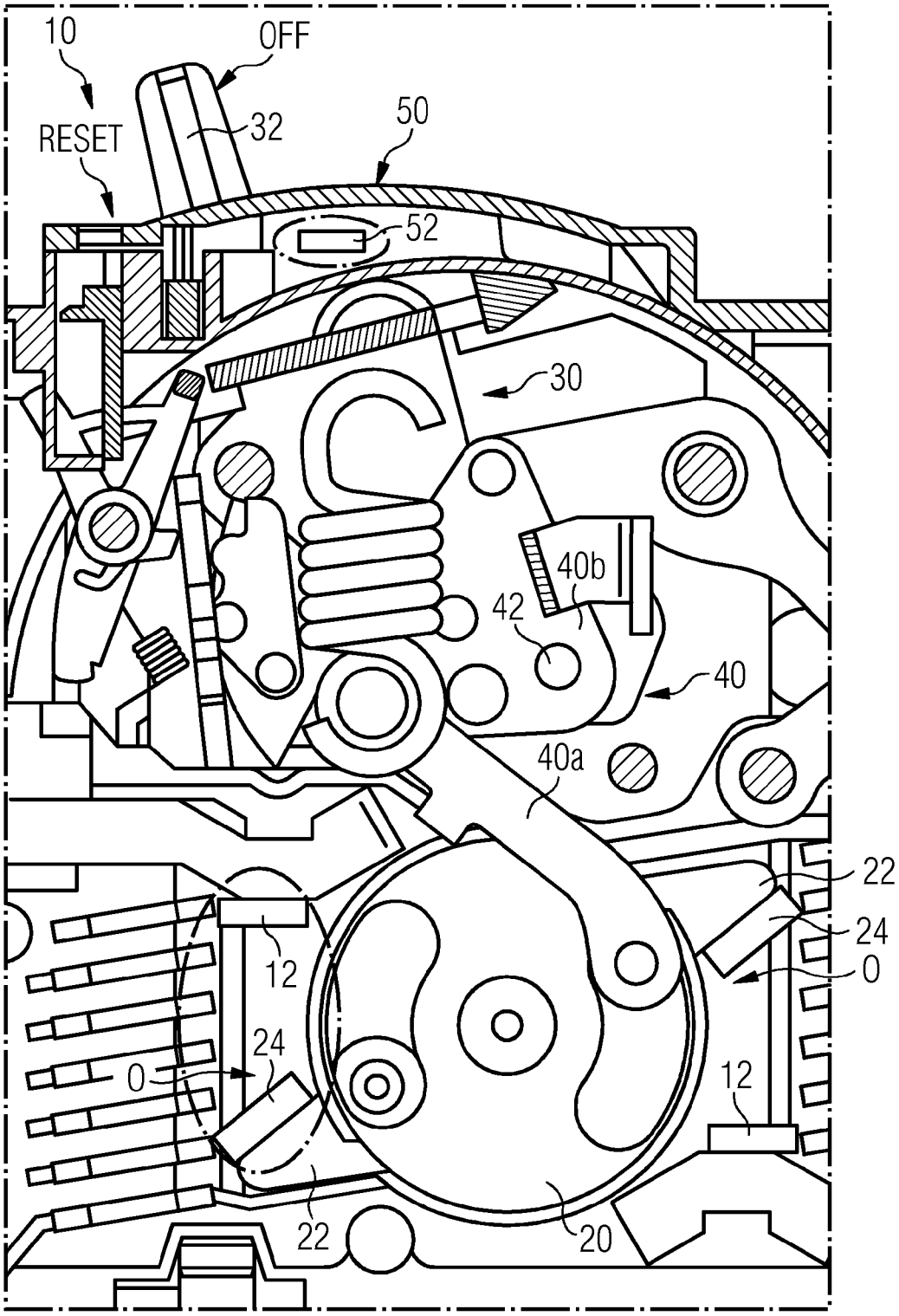
FIG. 1 shows an embodiment of an inventive switching apparatus with the switching lever in the OFF position.

The present invention will be further described in detail in conjunction with the accompanying drawings and embodiments. It should be understood that the particular embodiments described herein are only used to illustrate the present invention but not to limit the present invention.

Accordingly, while example embodiments of the invention are capable of various modifications and alternative forms, embodiments thereof are shown by way of example in the drawings and will herein be described in detail. It should be understood, however, that there is no intent to limit example embodiments of the present invention to the particular forms disclosed. On the contrary, example embodiments are to cover all modifications, equivalents, and alternatives falling within the scope of the invention. Like numbers refer to like elements throughout the description of the figures.

Specific structural and functional details disclosed herein are merely representative for purposes of describing example embodiments of the present invention. This invention may, however, be embodied in many alternate forms and should not be construed as limited to only the embodiments set forth herein.

It will be understood that, although the terms first, second, etc. may be used herein to describe various elements, these elements should not be limited by these terms. These terms are only used to distinguish one element from another. For example, a first element could be termed a second element, and, similarly, a second element could be termed a first element, without departing from the scope of example embodiments of the present invention. As used herein, the term "and/or," includes any and all combinations of one or more of the associated listed items.

It will be understood that when an element is referred to as being "connected," or "coupled," to another element, it can be directly connected or coupled to the other element or intervening elements may be present. In contrast, when an element is referred to as being "directly connected," or "directly coupled," to another element, there are no intervening elements present. Other words used to describe the relationship between elements should be interpreted in a like fashion (e.g., "between," versus "directly between," "adjacent," versus "directly adjacent," etc.).

The terminology used herein is for the purpose of describing particular embodiments only and is not intended to be limiting of example embodiments of the invention. As used herein, the singular forms "a," "an," and "the," are intended to include the plural forms as well, unless the context clearly indicates otherwise. As used herein, the terms "and/or" and "at least one of" include any and all combinations of one or more of the associated listed items. It will be further understood that the terms "comprises," "comprising," "includes," and/or "including," when used herein, specify the presence of stated features, integers, steps, operations, elements, and/or components, but do not preclude the presence or addition of one or more other features, integers, steps, operations, elements, components, and/or groups thereof.

It should also be noted that in some alternative implementations, the functions/acts noted may occur out of the order noted in the figures. For example, two figures shown in succession may in fact be executed substantially concurrently or may sometimes be executed in the reverse order, depending upon the functionality/acts involved.

Unless otherwise defined, all terms (including technical and scientific terms) used herein have the same meaning as commonly understood by one of ordinary skill in the art to which example embodiments belong. It will be further understood that terms, e.g., those defined in commonly used dictionaries, should be interpreted as having a meaning that is consistent with their meaning in the context of the relevant art and will not be interpreted in an idealized or overly formal sense unless expressly so defined herein.

Spatially relative terms, such as "beneath", "below", "lower", "above", "upper", and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, term such as "below" can encompass both an orientation of above and below. The device may be otherwise oriented (rotated 90 degrees or at other orientations) and the spatially relative descriptors used herein are interpreted accordingly.

Although the terms first, second, etc. may be used herein to describe various elements, components, regions, layers and/or sections, it should be understood that these elements, components, regions, layers and/or sections should not be limited by these terms. These terms are used only to distinguish one element, component, region, layer, or section from another region, layer, or section. Thus, a first element, component, region, layer, or section discussed below could be termed a second element, component, region, layer, or section without departing from the teachings of the present invention.

At least one embodiment of an inventive switching apparatus also has a switching unit with a switching lever that can be moved between an ON position and an OFF position. A switching frame is also provided for the switching unit, with a lever mechanism being in functional contact with the switching frame and the rotor housing in such a manner that movement of the switching lever into the ON position allows the rotor housing to be moved into the closed position and movement of the switching lever into the OFF position allows the rotor housing to be moved into the open position. In other words the switching of the switching apparatus is performed manually in this manner.

If the user of at least one embodiment of an inventive switching apparatus wishes to activate the power circuit, said user will move the switching lever into the ON position. This movement is transmitted by way of the lever mechanism to the rotor housing, so that said rotor housing rotates from the open position into the closed position and in the process the moving contact moves into the position of electrically conducting contact with the fixed contact of the switching apparatus. If the user wishes to deactivate the switching apparatus manually, in other words to isolate the power circuit, said user moves the switching lever into the OFF position. This movement is thus transmitted by way of the lever mechanism to the rotatable rotor housing. The rotor housing is moved into the open position, so that the moving contact leaves the fixed contact and the power circuit is thus isolated.

At least one embodiment of an inventive switching apparatus is characterized in that the lever mechanism has at least one stop. The stop is configured in such a manner that when the rotor housing is in the closed position, a movement of the switching lever into the OFF position, independently of the movement of the rotor housing, is prevented. This means that if there is a failure when isolating the moving contact from the fixed contact, it is in principle possible to decouple the switching lever from the movement of the rotor housing but the switching lever cannot be moved fully into the OFF position. According to at least one embodiment of the invention movement into the OFF position is impeded both directly and indirectly by way of a RESET position. This is achieved mechanically by the inventive stop.

At least one embodiment of an inventive configuration of the switching apparatus allows the safety of such a switching apparatus to be improved. If the switching apparatus is in a state, in which clean isolation of the moving contact from the fixed contact is not possible for a wide range of reasons, the switching lever can also not be moved into the OFF position. The reason for such a contact failure can be for example a trip situation, in which after a trip mechanism has tripped, the switching lever moves out of the ON position into a TRIP position. This means that the user of an inventive switching apparatus receives the information about the trip state by way of the positioning of the switching lever. However the user does not have information about whether the moving contacts have actually been released from the fixed contacts of the switching apparatus. Instead only the movement of the switching lever is evident.

If arcing results on tripping and the arcing and corresponding energy cause the welding of the moving contact to the fixed contact, this is not visible to the user from outside the switching apparatus.

If the user of at least one embodiment of an inventive switching apparatus wishes to reactivate it, said user will wish to reset the trip mechanism. For this user has to move the switching lever directly into the OFF position or by way of a RESET position into said OFF position. However at least one embodiment of the inventive stop prevents or forbids precisely this movement, if contacts cannot be released. This ensures that it is not possible to charge the trip mechanism or move the switching lever into the OFF position, when a failure is present on the part of the moving contact in relation to the fixed contact. In other words the positive off effect referred to in the introduction to this description can be avoided.

If there is a failure present between moving contact and fixed contact, it is impossible, despite decoupling from the movement of the rotor housing, to move the switching lever into an OFF position, which would then incorrectly suggest an isolated power circuit. This improves the operating safety of at least one embodiment of an inventive switching apparatus. In other words, by unsuccessfully trying to move the switching lever into the OFF position, the user receives feedback that there is a problem with the isolation of the moving contact from the fixed contact.

At least one embodiment of an inventive switching apparatus is operated in particular based on an operating instruction, according to which a movement by way of a RESET position into the OFF position must take place before activation of the switching apparatus, in other words before the switching lever is moved into the ON position. If the user follows this operating instruction, said user ascertains automatically with an inventive switching apparatus whether or that a failure is present with the release of the moving contact from the fixed contact.

The functional connection between the lever mechanism and the switching frame or the rotor housing is preferably configured to be rotatable and/or fixed. For example it can be affected by way of one or a number of shafts, so that the lever mechanism can also be referred to as one or a number of toggle joints. It is thus possible to generate relative movements and changed leverage situations, which inventively allow the transmission of the movement between the switching lever and the rotor housing.

It can be advantageous with at least one embodiment of an inventive switching apparatus if the lever mechanism has at least two levers that can be moved relative to one another. These levers are connected to one another at one end. At the respective other end of the respective lever, the respective lever is connected functionally to the switching frame or the rotor housing. This means that said lever mechanism can also be referred to as a double toggle joint. Despite a particularly compact structure, it is therefore possible to achieve a desired enlargement of the lever arms. This allows larger forces to be achieved when transmitting the respective movement or when transmitting the respective force, in particular in the event of tripping, in the spring element of a trip mechanism.

It is also advantageous with at least one embodiment of an inventive switching apparatus if the switching frame has a stop surface for the stop of the lever mechanism. The stop surface is configured in such a manner that when the rotor housing is in the closed position, the stop prevents movement of the switching lever into the OFF position, independently of the movement of the rotor housing, by geometric correlation of lever mechanism with the switching frame. In other words the stop comes up against the switching frame. This means that there is geometric blocking or stopping of the stop at the switching frame, so that further movement of the switching frame and the switching lever of the switching unit connected thereto is prevented. This improves the compactness of at least one embodiment of the inventive switching apparatus. Stopping at a stop surface preferably takes place with linear or surface contact. This allows a relatively large force to be withstood, so that the stop cannot be overcome in an unwanted manner by means of powerful action on the switching lever.

A further advantage can be achieved with at least one embodiment of an inventive switching apparatus if the switching lever can also be moved into a TRIP position, which is disposed between the ON position and the OFF position. This TRIP position preferably corresponds to a trip situation by means of a trip mechanism, in other words isolation of the moving contact from the fixed contact. Driven by the trip mechanism, the switching lever springs automatically into said TRIP position, when the trip mechanism trips.

It can also be advantageous with at least one embodiment of an inventive switching apparatus if the switching lever can also be moved into a RESET position, which is disposed on the other side of the OFF position in relation to the ON position. When at least one embodiment of an inventive switching apparatus has tripped, the switching lever is preferably in the TRIP position. In order to subject the trip mechanism to force once again or to tension it, the user moves the switching lever by way of the RESET position into the OFF position and can then move said switching lever back into the ON position. The RESET position therefore serves to move the switching lever out by way of the OFF position and therefore represents the start of charging the trip mechanism. The other side of the OFF position in relation to the ON position relates in particular to the movement direction of the switching lever.

A further advantage can be achieved in that with at least one embodiment of an inventive switching apparatus a blocking apparatus is provided to block the movement of the switching lever from the OFF position in the direction of the ON position. The stop of the lever mechanism here is configured in such a manner that the blocking apparatus cannot be actuated when a rotor housing is in the closed position. In particular the stop of the lever mechanism is configured in such a manner that in the TRIP position or when the switching lever moves from the TRIP position to the OFF position, the blocking apparatus cannot be actuated.

The blocking apparatus can be configured as one or a number of pieces. It serves, in particular according to an operating instruction for an inventive switching apparatus, to fix the switching lever in the OFF position. When a machine is to be inspected, it has to be deactivated first. This is done for example by moving the switching lever into the OFF position. To ensure that, after the machine has been opened or entered, a second person cannot move the switching lever back into the ON position, the switching lever is secured in the OFF position by way of the blocking apparatus. Such securing can only take place when the switching lever is fully in the OFF position. At least one embodiment of the inventively configured blocking apparatus therefore not only prevents the fundamental movement of the switching lever into the OFF position but also prevents the switching lever becoming blocked in a position in proximity to the OFF position, in particular in the region of the TRIP position.

At least one embodiment of an inventive switching apparatus is particularly advantageously configured, if the blocking apparatus has at least one blocking opening, through which a securing can be introduced. The securing means is introduced to prevent movement of the switching lever to leave the OFF position. The securing device can be for example a longish element, in particular a securing splint. The OFF position is secured by introducing the securing means so that the movement of the switching lever in the direction of the ON position is blocked. The introduction of the securing device into the blocking opening can only take place when the blocking opening is fully or essentially fully released by the switching lever. The blocking opening is thus preferably disposed in such a manner that the full release of the blocking opening can only take place when the switching lever is fully in the OFF position. There is therefore preferably a geometric correlation between the blocking opening on the one hand and the movement direction of the switching lever on the other hand.

At least one embodiment of an inventive switching apparatus can be developed so that the stop is configured as a pin of the lever mechanism, in particular as a connecting pin between two sides of the lever mechanism. The pin thus has a dual function as a stop and as a connection between the two sides of the lever mechanism. It can therefore be configured in a particularly economical and compact manner. The pin or connecting pin runs in particular perpendicular or essentially perpendicular to the movement direction of the switching lever.

It is further advantageous with at least one embodiment of an inventive switching apparatus if the stop interacts with a display apparatus. This indicates the prevention of a movement of the switching lever into the OFF position, independently of the movement of the rotor housing into the closed position. If an attempt is made to move the switching lever from the TRIP position into the OFF position when the moving contacts are welded for example to the fixed contacts, this is not possible due to the stop. This embodiment also inventively provides an indication with the aid of the display apparatus, for example by moving a display element into a window opening in the housing of the switching apparatus. This also provides visual feedback that a possible failure has occurred during the isolation of the moving contacts from the fixed contacts.

Figure 2:
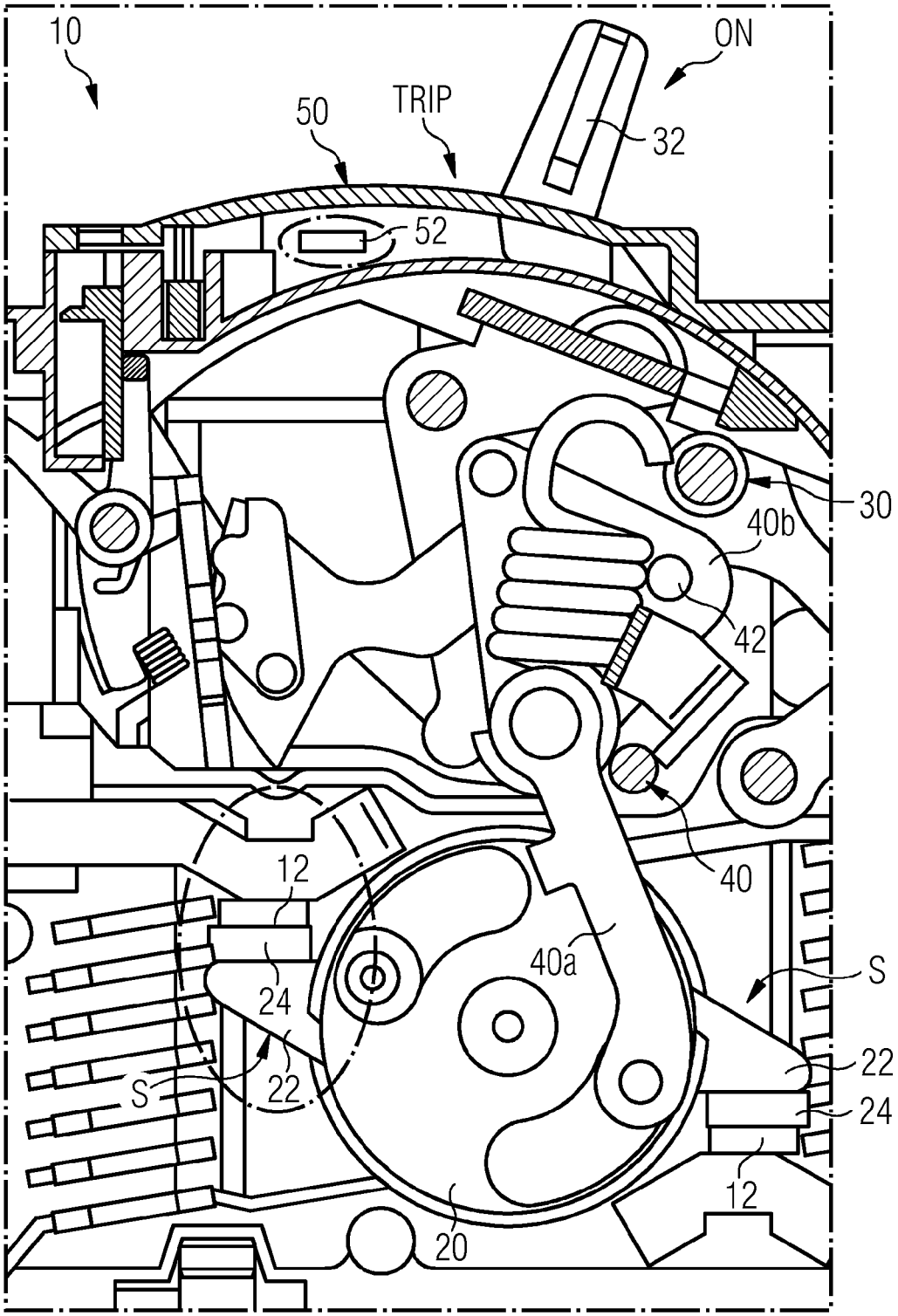
FIG. 2 shows the embodiment from FIG. 1 with the switching lever in the ON position and FIG. 3 shows the embodiments from FIGS. 1 and 2 with the switching lever in a position, in which movement into the OFF position is blocked.
Figure 3:
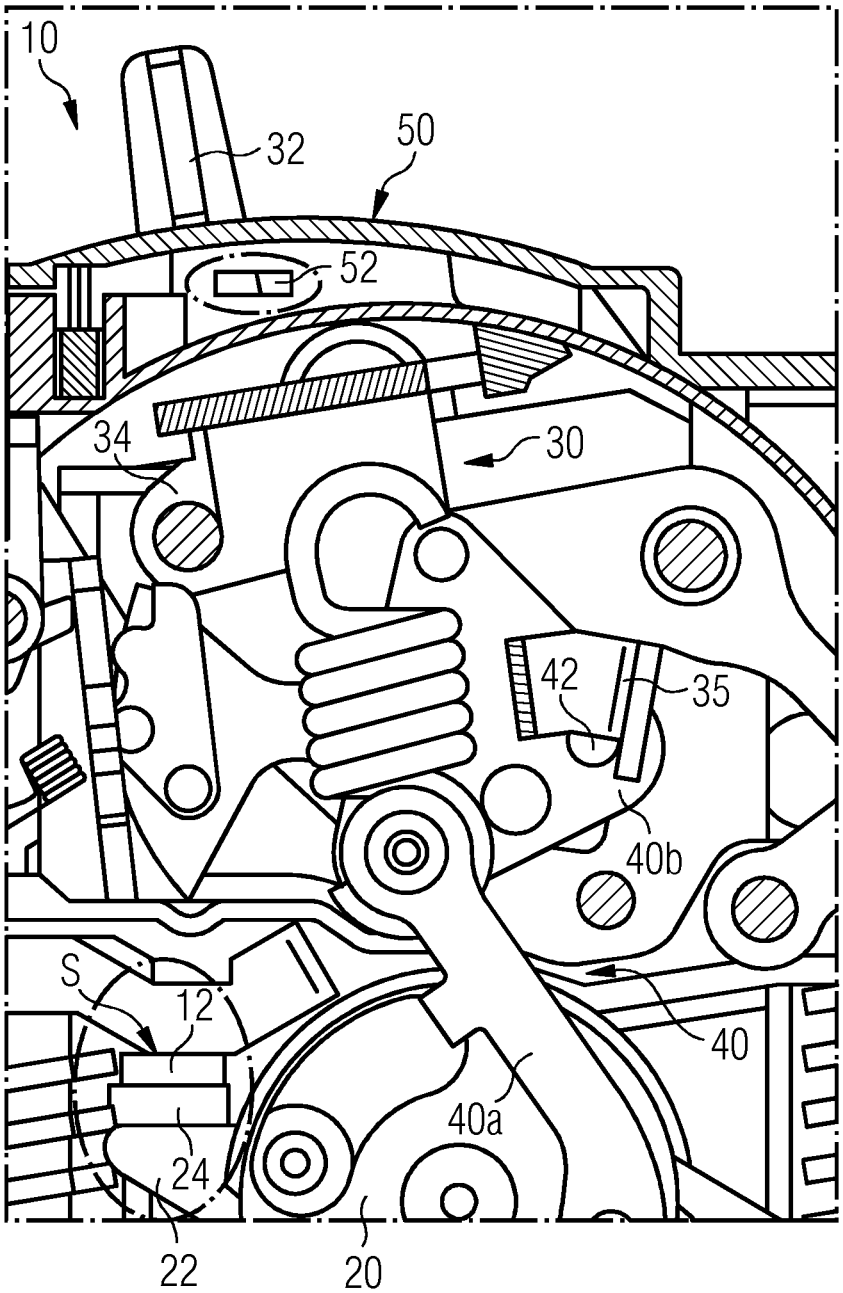

FIGS. 1 to 3 show an embodiment of an inventive switching apparatus 10. The basic components of this embodiment are all identical. The switching apparatus 10 therefore has a rotor housing 20, which is provided with two contact arms 22. These are disposed on opposing sides of the rotor housing 22 and each have a moving contact 24. In FIG. 1, in other words when the switching lever 32 is in the OFF position, the moving contacts 24 are isolated from the fixed contacts 12 opposite them, in other words the rotor housing is in the open position O. In FIG. 2 the rotor housing 20 has been rotated, so that the moving contacts 24 are disposed in electrically conducting contact with the fixed contacts 12 and the rotor housing 20 is therefore in the closed position S.

An embodiment of the inventive switching apparatus 10 also has a switching unit 30. The essential components of the switching unit 30 are a switching lever 32, which projects through an opening in the housing of the switching apparatus 10. A further essential component of the switching unit 30 is a switching frame 34, which can be moved together with the switching lever 32 and is clearly shown in particular in FIG. 3.

A lever mechanism 40 is provided for the functional connection between the switching unit 30 and the rotor housing 20. In this embodiment it is embodied as a double toggle joint, so it has a first lever 40*a* and a second lever 40*b*. The levers 40*a* and 40*b* are connected to one another by way of a pin. The connection to the rotor housing 20 on the one hand and the switching unit 30, in particular the switching frame 34, on the other hand is also embodied by way of pins. The second lever 40*b* also has a stop 42 in the form of a pin, which functions in an inventive manner as described below.

When an inventive switching apparatus operates in standard mode, the use situation only alternates between FIGS. 1 and 2. FIG. 1 shows the OFF position OFF of the switching lever 32, in which the rotor housing 20 is in the open position O. If there is a wish to activate a power circuit, the switching lever 32 is moved into the ON position ON, with the result that the rotor housing 20 is rotated automatically into the closed position S. Movement here is transmitted solely by way of the lever mechanism 40. The TRIP position TRIP, which corresponds to the trip state of the switching apparatus 10, is between the positions ON and OFF of the switching lever 32. When it is moved beyond the OFF position OFF, the switching lever 32 can reach a RESET position RESET.

When tripping takes place by way of a trip mechanism in an inventive switching apparatus 10, the switching lever 32 moves from the ON position ON for example into the TRIP position TRIP. It can however happen that the moving contacts 24 are welded to the fixed contacts 12, for example due to the occurrence of arcing. Thus, despite movement of the switching lever 32 from the ON position ON, the moving contacts 24 cannot be released from the fixed contacts 12. This situation is illustrated in FIG. 3. The switching lever 32 has left the ON position ON but the moving contacts 24 are still in contact with the fixed contacts 12. It can also be seen that the stop 42 of the second lever 40*b* has now come into linear contact or surface contact with a stop surface 35 of the switching frame 34. This prevents the switching lever 32 being moved further. In particular it prevents the switching lever 32 reaching the OFF position OFF and/or the RESET position RESET.

A blocking apparatus 50 can also be seen in FIGS. 1 to 3. It is embodied with a blocking opening 52. Said blocking opening 52 is released for example according to FIG. 1 when the switching lever 32 is in the OFF position OFF, so that in this situation a securing means, for example a securing splint, can be pushed through the blocking opening 52. In this pushed through position the securing splint secures the switching lever 32 in the OFF position OFF, so that the switching lever 32 cannot be moved in the direction of the ON position ON. However securing is only possible, when the blocking opening 52 of the blocking apparatus 50 is released. This is not possible however when the stop 42 is inventively engaged with the switching frame 34, as shown in FIG. 3. The cross section of the switching lever 32 here overlaps with the free opening cross section of the blocking opening 52, so that the blocking opening 52 is not released for the introduction of a securing means. Therefore in this position the switching lever 32 prevents the blocking of the switching lever 32, as it has not reached the OFF position OFF to a sufficient degree.

The above description of the example embodiment only describes the present invention in the context of examples. Individual described features can therefore be combined freely with one another, in so far as this is technically expedient, without departing from the scope of the present invention.

The example embodiment or each example embodiment should not be understood as a restriction of the invention. Rather, numerous variations and modifications are possible in the context of the present disclosure, in particular those variants and combinations which can be inferred by the person skilled in the art with regard to achieving the object for example by combination or modification of individual features or elements or method steps that are described in connection with the general or specific part of the description and are contained in the claims and/or the drawings, and, by way of combinable features, lead to a new subject matter or to new method steps or sequences of method steps, including insofar as they concern production, testing and operating methods.

References back that are used in dependent claims indicate the further embodiment of the subject matter of the main claim by way of the features of the respective dependent claim; they should not be understood as dispensing with obtaining independent protection of the subject matter for the combinations of features in the referred-back dependent claims.

Furthermore, with regard to interpreting the claims, where a feature is concretized in more specific detail in a subordinate claim, it should be assumed that such a restriction is not present in the respective preceding claims.

Since the subject matter of the dependent claims in relation to the prior art on the priority date may form separate and independent inventions, the applicant reserves the right to make them the subject matter of independent claims or divisional declarations. They may furthermore also contain independent inventions which have a configuration that is independent of the subject matters of the preceding dependent claims.

Further, elements and/or features of different example embodiments may be combined with each other and/or substituted for each other within the scope of this disclosure and appended claims.

Still further, any one of the above-described and other example features of the present invention may be embodied in the form of an apparatus, method, system, computer program, tangible computer readable medium and tangible computer program product. For example, of the aforementioned methods may be embodied in the form of a system or device, including, but not limited to, any of the structure for performing the methodology illustrated in the drawings.

Example embodiments being thus described, it will be obvious that the same may be varied in many ways. Such variations are not to be regarded as a departure from the spirit and scope of the present invention, and all such modifications as would be obvious to one skilled in the art are intended to be included within the scope of the following claims.

REFERENCE CHARACTERS

10 Switching apparatus
12 Fixed contact
20 Rotor housing
22 Contact arm
24 Moving contact
30 Switching unit
32 Switching lever
34 Switching frame
35 Stop surface
40 Lever mechanism
40*a* First lever
40*b* Second lever
42 Stop
50 Blocking apparatus
52 Blocking opening
O Open position
S Closed position
OFF OFF position
ON ON position
TRIP TRIP position
RESET RESET position

What is claimed is:

1. A switching apparatus for an electrical switching device, comprising:

a rotor housing, rotatable between an open position and a closed position;

at least one contact arm with a moving contact directly affixed to the rotor housing, the moving contact, in the closed position of the rotor housing, being in contact with a fixed contact of the switching apparatus in an electrically conducting manner;

a switching unit including a switching lever that projects out of an opening in a housing of the switching apparatus, movable between an ON position and an OFF position, and a rotatable switching frame having a stop surface;

a lever mechanism in functional contact with the switching frame and the rotor housing such that movement of the switching lever into the ON position allows the rotor housing to be moved into the closed position and movement of the switching lever into the OFF position allows the rotor housing to be moved into the open position, the lever mechanism including at least one stop, configured to be in surface contact with the stop surface of the switching frame to prevent movement of the switching lever into the OFF position independently of the movement of the rotor housing when the rotor housing is in the closed position.

2. The switching apparatus of claim 1, wherein the lever mechanism includes at least two levers that are movable relative to one another, the at least two levers being functionally connected to one another at one end and at the respective other end, being functionally connected to the switching frame or the rotor housing.

3. The switching apparatus of claim 1, wherein the switching frame includes a stop surface for the stop of the lever mechanism, so that when a rotor housing is in the closed position, the stop prevents movement of the switching lever into the OFF position, independently of the movement of the rotor housing, by geometric correlation of the lever mechanism with the switching frame.

4. The switching apparatus of claim 1, wherein the switching lever is movable into a TRIP position, disposed between the ON position and the OFF position.

5. The switching apparatus of claim 1, wherein the switching lever is movable into a RESET position, disposed on another side of the OFF position in relation to the ON position.

6. The switching apparatus of claim 1, further comprising a blocking apparatus, configured to block the movement of the switching lever from the OFF position in the direction of the ON position, the stop of the lever mechanism being configured in such a manner that the blocking apparatus cannot be actuated when a rotor housing is in the closed position.

7. The switching apparatus of claim 6, wherein the blocking apparatus includes at least one blocking opening, through which a securing device is introducible to prevent movement of the switching lever to leave the OFF position.

8. The switching apparatus of claim 1, wherein the stop is configured as a pin in the lever mechanism.

9. The switching apparatus of claim 1, wherein the stop interacts with a display apparatus, which indicates the prevention of a movement of the switching lever into the OFF position, independently of the movement of the rotor housing in the closed position.

10. An electrical switching device, comprising at least one switching apparatus of claim 1.

11. The switching apparatus of claim 1, wherein the switching apparatus is for an electrical switching device.

12. The switching apparatus of claim 2, wherein the switching lever is movable into a TRIP position, disposed between the ON position and the OFF position.

13. The switching apparatus of claim 2, wherein the switching lever is movable into a RESET position, disposed on another side of the OFF position in relation to the ON position.

14. The switching apparatus of claim 4, wherein the switching lever is movable into a RESET position, disposed on another side of the OFF position in relation to the ON position.

15. The switching apparatus of claim 2, further comprising a blocking apparatus, configured to block the movement of the switching lever from the OFF position in the direction of the ON position, the stop of the lever mechanism being configured in such a manner that the blocking apparatus cannot be actuated when a rotor housing is in the closed position.

16. The switching apparatus of claim 15, wherein the blocking apparatus includes at least one blocking opening, through which a securing device is introducible to prevent movement of the switching lever to leave the OFF position.

17. The switching apparatus of claim 8, wherein the stop is configured as a connecting pin between two sides of the lever mechanism.

18. The electrical switching device of claim 10, wherein the electrical switching device is a molded case circuit breaker.

* * * * *